United States Patent [19]

Fujita et al.

[11] 4,355,381

[45] Oct. 19, 1982

[54] ELECTRONIC TIMEPIECE WITH ELECTRO-OPTIC DISPLAY

[75] Inventors: Masanori Fujita; Yoshihito Owa, both of Tokyo, Japan

[73] Assignee: Seikosha Co., Ltd., Japan

[21] Appl. No.: 152,025

[22] Filed: May 21, 1980

[30] Foreign Application Priority Data

May 23, 1979 [JP] Japan ..... 54-64169

[51] Int. Cl.[3] ..... G04C 9/00

[52] U.S. Cl. ..... 368/187; 368/242

[58] Field of Search ..... 368/69, 188, 70, 184–187; 340/756, 759, 805

[56] References Cited

U.S. PATENT DOCUMENTS 3,810,356 4/1974 Fujita ..... 368/69

4,209,974 7/1980 Noble ..... 368/232

*Primary Examiner*—Bernard Roskoski

*Attorney, Agent, or Firm*—Robert E. Burns; Emmanuel J. Lobato; Bruce L. Adams

[57] ABSTRACT

An electronic timepiece has a liquid crystal display device in which a plurality of liquid crystal display elements each in the shape of a time-indicating hand are radially arrayed and the liquid crystal display elements are selectively turned on responsive to time-divided time information. A set of counters produce the time data only during time adjustment when the contents in the counters are adjusted, predetermined time units of the time data are selected extending over a longer time than other remaining time units so that there is obtained a larger effective value of voltage to be applied to the liquid crystal display elements in comparison with the case of non-adjustment so that even if the time adjustment is quickly made, one may recognize a display portion which is sequentially turned on in response to the time data.

4 Claims, 9 Drawing Figures

| Vs-c \ Vs | | | S0 | | S1 | |
|---|---|---|---|---|---|---|
| Vc | | | 3V0 | 0 | V0 | 2V0 |
| C0 | 0 | 3V0 | 3V0 | -3V0 | V0 | -V0 |
| C1 | 2V0 | V0 | V0 | -V0 | -V0 | V0 |

ELECTRONIC TIMEPIECE WITH ELECTRO-OPTIC DISPLAY

BACKGROUND OF THE INVENTION

This invention relates to an electronic timepiece and more especially to a timepiece with liquid crystal display elements simulating an hour hand and minute hand and, if desired, a second hand.

There has been heretofore a liquid crystal display device in which as the contents to be displayed on the display device are quickly changed by means of an adjusting means, the display of the display device is not capable of responding to the quick changing of the contents to be displayed, so that one display on the display device disappears or represents meaningless contents. Accordingly in an electronic timepiece provided with such a display device, as the contents in the counters for counting time are changed at a high frequency, one time-display on the display device is not capable of responding to the quickly changed contents, and as a result, a correct time display is not made. Consequently it has been a fear that one who adjusts the time has doubts that there may have been some trouble with the display device.

SUMMARY OF THE INVENTION

One object of this invention is to provide a new electronic timepiece.

Another object of this invention is to provide an electronic timepiece having a plurality of liquid crystal display elements which are radially arrayed and circuitry operable during normal time display for time-divisionally selecting timing signals representative of units of time and converting the selected signals to pulsed voltages which are applied to the display elements, and operable during time adjustment for stopping the selection of predetermined timing signals and increasing the period during which timing signals corresponding to time units being adjusted are selected so that the pulsed voltages corresponding to the time units being adjusted are applied to the display elements for a longer period of time as compared to the normal time display thereby increasing the effective value of the pulsed voltages so as to improve the contrast between display and non-display portions of the display elements, and even if the time adjustment is quickly made, the time adjusting contents are always displayed by the display elements.

BRIEF DESCRIPTION OF THE DRAWINGS

The invention is illustrated in and further explained in connection with the accompanying drawings, in which.

DESCRIPTION OF THE PREFERRED EMBODIMENTS

Figure 1A:
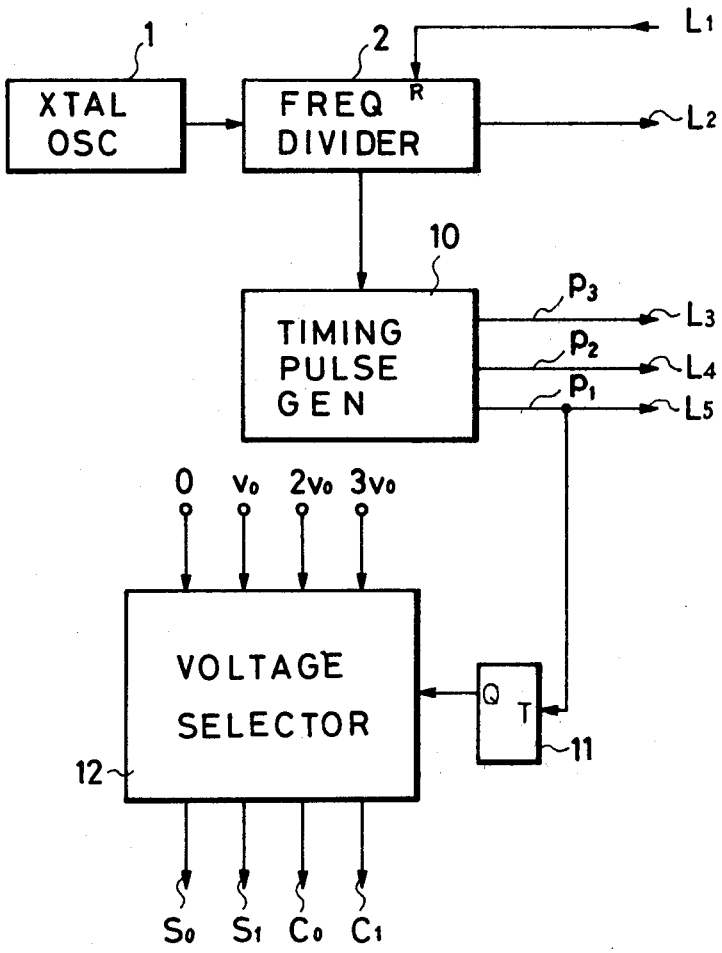
FIGS. 1A, 1B and 1C are a diagramatic block circuit representation of one embodiment of the invention.
Figure 1B:
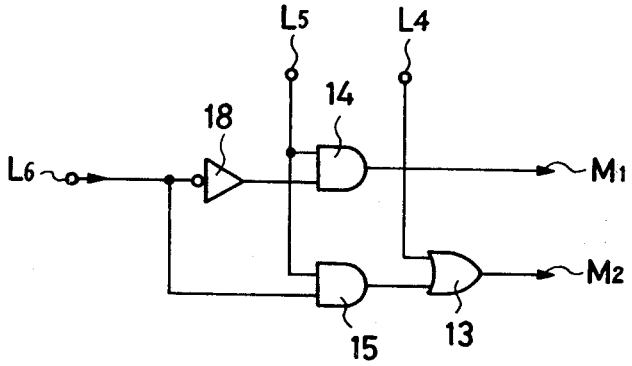
Figure 1C:
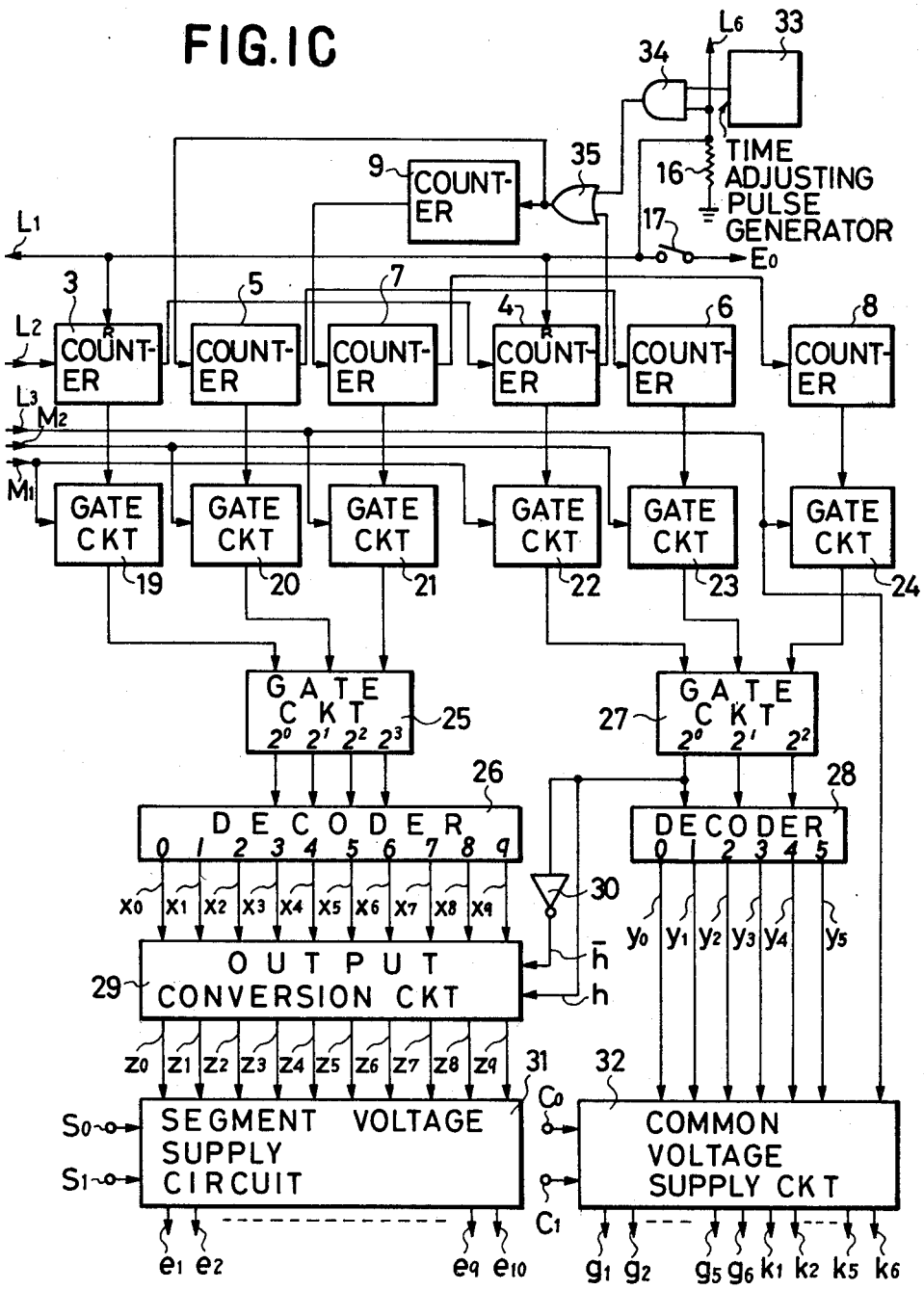

Referring to FIGS. 1A, 1B and 1C block 1 represents a crystal controlled time standard oscillator the output of which is divided down in frequency by a multi-stage frequency divider 2 the reduced frequency output from which is fed to a decimal counter 3 counting a time unit of seconds. A carry output of the decimal counter 3 is fed to a divide-by-six counter 4. A decimal counter 5 and a divide-by-six counter 6 count time units of minutes, and a decimal counter 7 and a divide-by-six counter 8 count time units of hours. All the aforementioned counters produce timing signal outputs in the form of binary decimal coded outputs. A duodecimal counter 9 counts a carry output pulse of the counter 4 or time adjusting pulses described later herein. A timing pulse generator 10 receives output pulses such as pulses of 128 Hz from the frequency divider 2 and successively produces timing pulses at terminals $P_1$ $P_3$. Perodical pulses produced at the terminal $P_1$ trigger a flip-flop circuit 11 which produces pulses at an output terminal Q thereof which are fed to a voltage selector 12. The voltage selector 12 produces periodically relative voltages 0, $v_0$, $2v_0$ and $3v_0$ at terminals $S_0$, $S_1$, $C_0$, and $C_1$, respectively. The pulses at the terminal $P_2$ of the timing pulse generator 10 are fed to an input terminal of OR gate circuit 13 via a line $L_4$ and the pulses at the terminal $P_1$ are fed to an input terminal of AND gate circuits 14 and 15 via a line $L_5$. An output appears along a resistor 16 depending upon the ON or OFF operation of a manual switch 17 connected to a positive potential $E_0$ and the output is directly fed to the other input terminal of the AND gate circuit 15 and is also fed via an inverter 18 to the other input terminal of the AND gate circuit 14. Gate circuits 19 to 21 having AND logic function control passage of input data thereof responsive to pulses fed via lines $M_2$, $M_1$ and $L_3$, respectively. Gate circuits 22 to 24 having AND logic function control passage of input data thereof responsive to the pulses fed via the lines $M_2$, $M_1$ and $L_3$, respectively. Gate circuit 25 having OR logic function feeds time data from the gate circuits 19 to 21 to a decoder 26 for converting code of input data thereof. Gate circuit 27 having OR logic function feeds time data from the gate circuits 22 to 24 to a decoder 28 for converting code of input data thereof. The output of the decoder 26 is fed to an output conversion circuit 29 for changing the order of outputs produced from output terminals $z_0$ to $z_9$ responsive to inputs fed directly and via an inverter 30 from a $2^0$ terminal of the gate circuit 27. The outputs of the output conversion circuit 29 are fed to a segment voltage supply circuit 31 for producing voltages to be applied to segment electrodes explained later herein. The outputs of the decoder 28 are fed to a common voltage supply circuit 32 to be applied to common electrodes explained later as well as the segment electrodes. Block 33 represents a time adjusting pulse generator the output pulses from which are generated in accordance with a rotation of a rotary means which is mounted to be rotated around an axis by manual operation. As an example thereof, reference is made to U.S. Pat. No. 4,196,584 and West German patent application No. P2805005.7 (Offenlegungsschrift No. 2805005) which were filed prior to the present application. The time adjusting pulses are fed to the counter 9 via an AND gate circuit 34 and an OR gate circuit 35.

Figure 2:
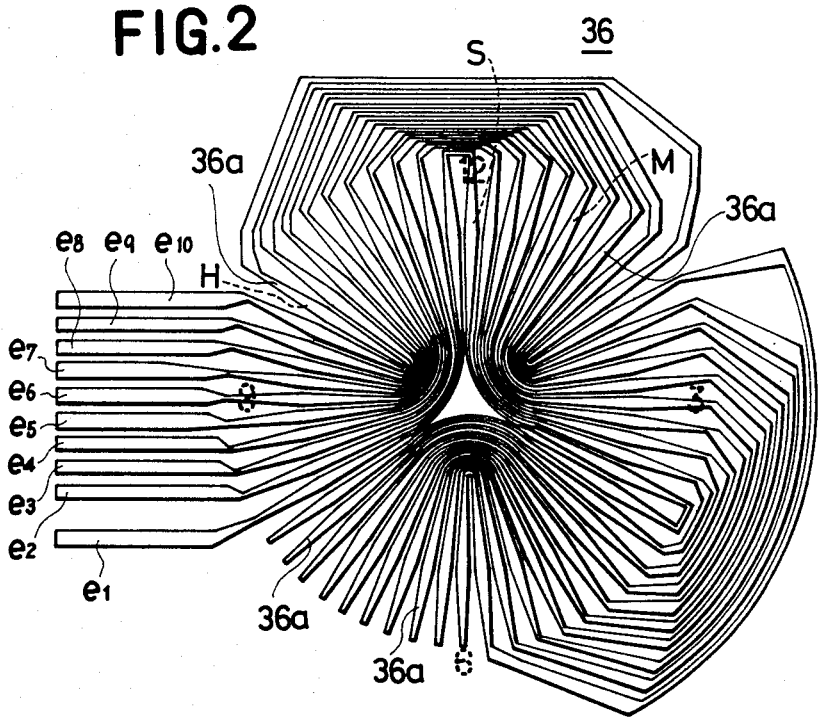
FIG. 2 is a plan view of the segment electrode system of a liquid crystal display device used in the embodiment of FIG. 1.

The display device is of the liquid crystal type and includes segment electrodes, generally designated 36 in FIG. 2, consisting of 60 radial segment electrodes 36*a* equally spaced round a circle. The first ten of the segment electrodes 36*a*—36*a* are respectively connected to the terminals $e_1$ to $e_{10}$ of the segment voltage supply circuit 31. The remaining segment electrodes are connected with the following relations. The count order of the segment electrodes designated below is in the clockwise direction starting with the segment electrode 36*a* which is connected to the terminal $e_1$ as the first one. The 10th segment electrode 36*a* is connected to the 11th; the 9th segment electrode is connected to the 12th—and the 1st segment electrode being connected to the 20th which is connected to the 21st; the 19th segment electrode being connected to the 22nd—the 11th segment electrode being connected to the 30th.

Figure 3:
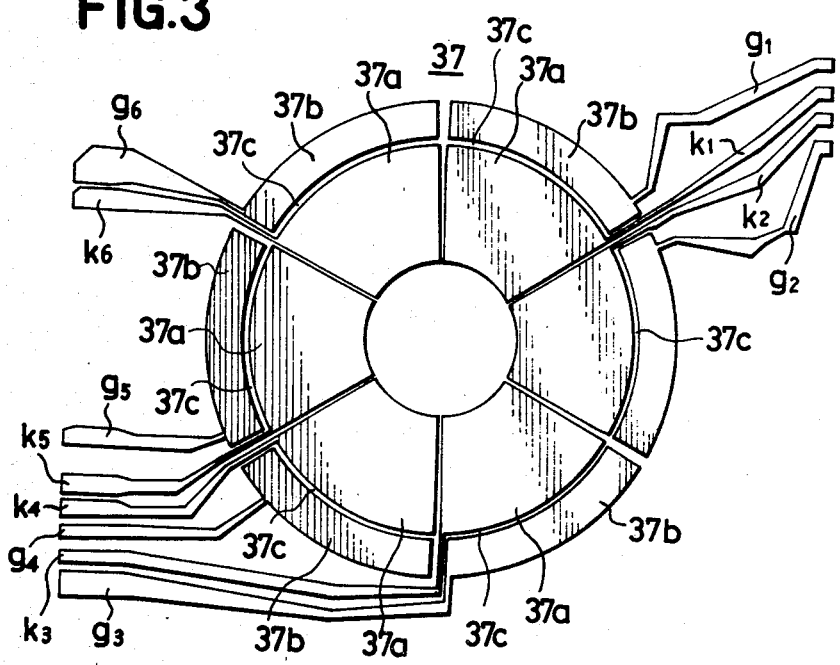
FIG. 3 is a plan view of the common electrode system of the display device the segment electrode system of which is shown in FIG. 2.

The display device also includes common electrodes, generally designated 37 in FIG. 3. The common electrodes consist of six similar inner common electrodes 37*a* and six similar outer common electrodes 37*b*. The radial spaces 37*c* which separate the individual common electrodes 37*a* and 37*b* from one another radially are located between the 10th segment electrode and the 11th; between the 20th segment electrode and the 21st; between the 30th segment electrode and the 31st; between the 40th segment electrode and the 41st; between the 50th segment electrode and 51st, and between the 60th segment electrode and the 1st (counting in the clockwise direction).

The segment electrode system is positioned over the common electrode system and a layer of liquid crystal material (not shown) is interposed between the two systems in a sealed housing (not shown) through which the display given can be observed.

Figure 4:
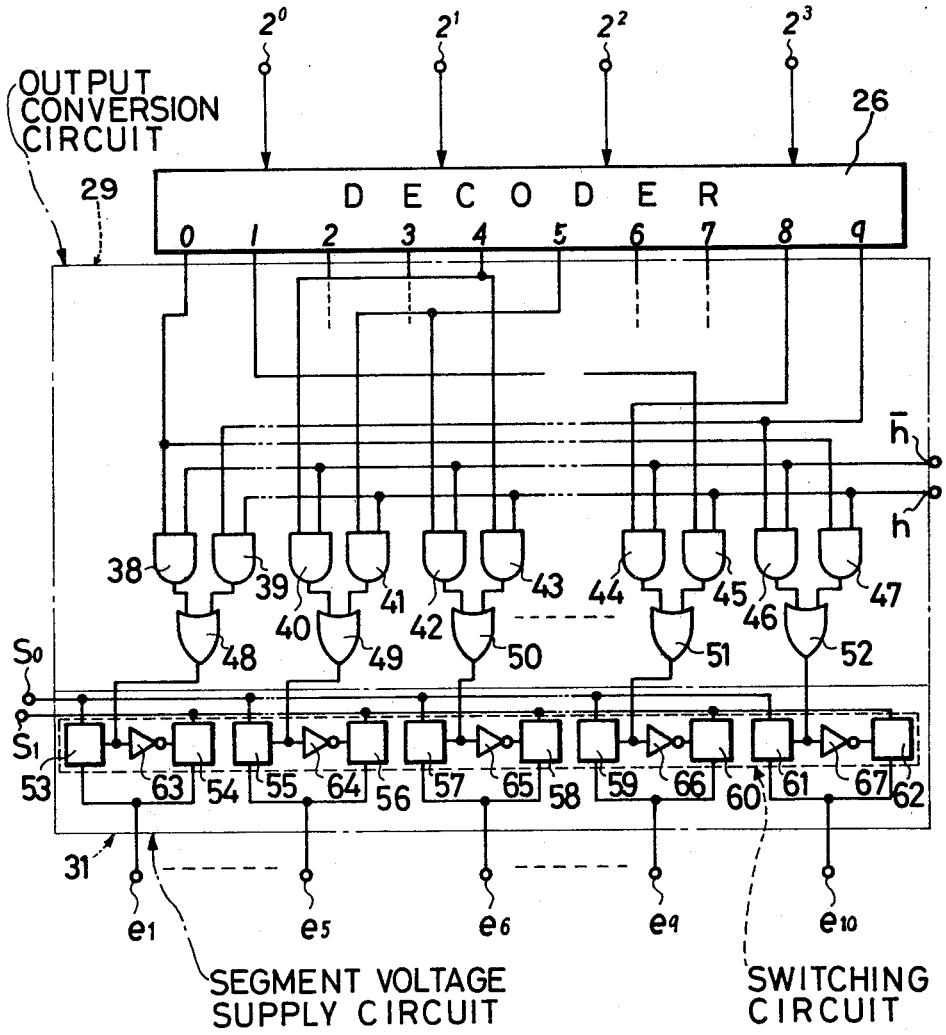
FIG. 4 is a diagram illustrating the output conversion circuit and the segment voltage supply circuit in the embodiment of FIG. 1.

FIG. 4 shows in some detail the output conversion circuit 29 and the segment voltage supply circuit 31 of FIG. 1. Reference numerals 38 to 47 denote AND gate circuits; 48 to 52 denote OR gate circuits; 53 to 62 are switching circuits which may be like those in FIG. 1; and 63 to 67 are inverters.

Figure 5:
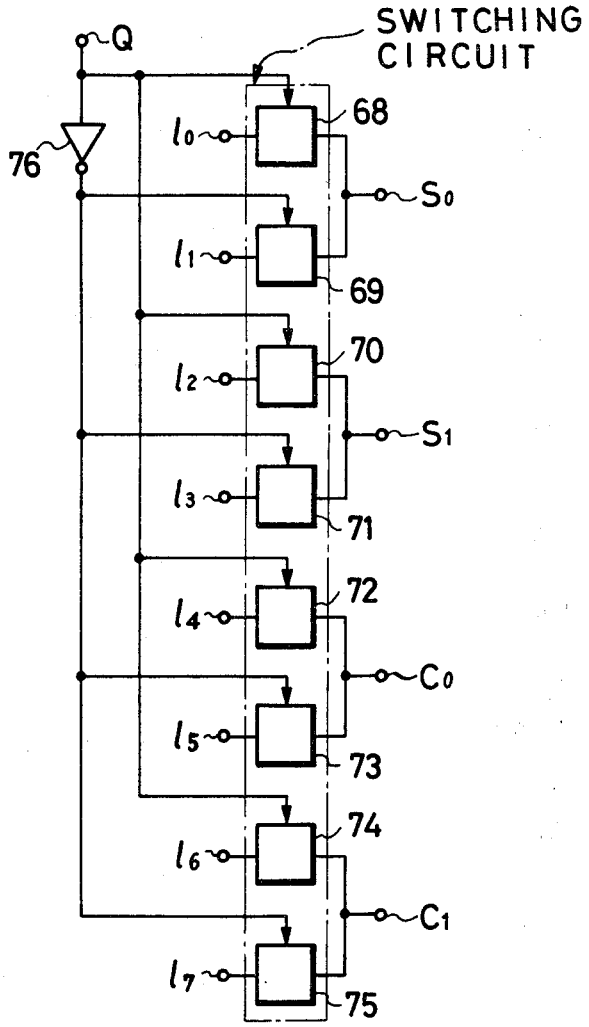
FIG. 5 is a diagram illustrating the voltage selector 12 in the embodiment of FIG. 1.

FIG. 5 shows in some detail the voltage selector 12 of FIG. 1A. References 68 to 75 denote switching circuits which may be constructed in the same manner as described in FIG. 1A; 76 is inverter.

Figures 6, 7:
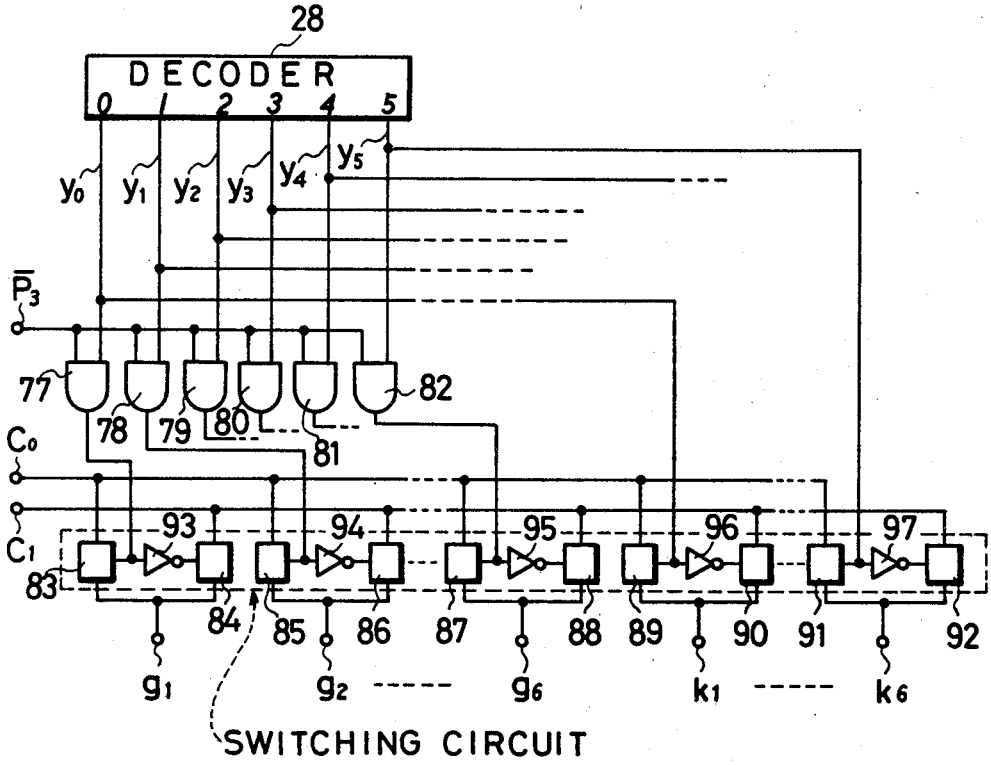
FIG. 6 is a diagram illustrating the common voltage supply circuit in the embodiment of FIG. 1.
FIG. 7 is a voltage table for illustrating the operation of FIG. 1.

FIG. 6 shows in some detail the common voltage supply circuit 32 of FIG. 1C. Reference numerals 77 to 82 denote AND gate circuits; 83 to 92 are switching circuits which may be constructed in the same manner as described above; and 93 to 97 are inverters.

A description will now be given of the relative voltages to be applied to the segment electrodes and the common electrodes.

Let it be assumed that values of the relative voltages are predetermined and that the liquid crystal display device used in this embodiment will not exhibit a display due to the periodical voltage differences between one of the segment electrodes and one of the common electrodes beneath it if the voltage differences are smaller than $|v_0|$ but will exhibit a display if the voltage differences are $3|v_0|$ or more. On this assumption, a voltage of 0(zero) is applied to terminals $1_1$ and $1_4$; a voltage $v_0$ is applied to terminals $1_2$ and $1_7$; a voltage $2v_0$ is applied to terminals $1_3$ and $1_6$; and a voltage $3v_0$ is applied to terminals $1_0$ and $1_5$.

In FIG. 1, when periodical pulses are produced at the terminal $P_1$ of the timing pulse generator 10, the respective pulses therefrom trigger the flip-flop circuit 11 thereby producing periodical pulses at the output terminal Q thereof. Consequently in FIG. 5, the voltages 0 and $3v_0$ are alternately produced at the terminal $S_0$; the voltages $v_0$ and $2v_0$ are alternately produced at the terminal $S_1$; the voltages 0 and $3v_0$ are alternately produced at the terminal $C_0$; and the voltages $2v_0$ and $v_0$ are alternately at the terminal $C_1$. The relations of those voltages are illustrated in a Table of FIG. 7. In this Table the voltages $v_s$ are those which may be assumed by the terminals $S_0$, $S_1$ and the voltages $v_c$ are those which may be assumed by the terminals $C_0$, $C_1$. Among these two groups of voltages, those on the left are voltages that will be produced at the terminals $S_0$, $S_1$, $C_0$ and $C_1$ every time a pulse is produced at the terminal $P_1$. In the remainder of the Table voltage differences between the respective voltages produced at the terminals $S_0$, $S_1$ and the respective voltages produced at the terminals $C_0$, $C_1$, namely the voltages of $v_{s-c}$ are illustrated. As will be seen from the Table, when a voltage is applied between the terminals $S_0$ and $C_0$ a display element corresponding to the electrodes connected thereto is displayed.

Under the aforementioned assumption, a description will now be given of the operation of the timepiece. When no time adjusting operation is being made, the manual switch 17 of FIG. 1C is kept open. Therefore the logic level on the line $L_6$ is a logic "0", which is inverted to a logic "1" by the inverter 18 to open the AND gate circuit 14. Therefore periodical pulses at the terminal $P_1$ of the timing pulse generator 10 appear at the output terminal of the AND gate circuit 14. Meanwhile periodical pulses at the terminal $P_2$ of the timing pulse generator 10 appear at the output terminal of the OR gate circuit 13 via the line $L_4$.

In order to explain a time display on the basis of a concrete example, let it be assumed that the counters 3 to 8 have counted 0 seconds 5 minutes past 10. In this case, the counter 3 counts "0"; the counter 4 counts "0"; the counter 5 counts "5"; the counter 6 counts "0"; the counter 7 counts "0"; the counter 8 counts "5"; and the counter 9 counts "5". In this state, when the periodical pulses are at the terminal $P_1$ of the timing pulse generator 10, the gate circuits 19 and 22 are opened to feed output data corresponding to time units of a second from the counter 3 to the gate circuit 25 and to feed another output data corresponding to time units of a second from the counter 4 to the gate circuit 27. Therefore a logic "0" is produced at the $2^0$ to $2^3$ terminals of the gate circuit 25 and also at the $2^0$ to $2^2$ terminals of the gate circuit 27. Consequently a logic "1" is produced at the terminal $\bar{h}$, a logic "0" is produced at the terminal h, and a logic "1" is produced at the terminal $x_0$ of the decoder 26. Meanwhile referring to the circuit of FIG. 4, a logic "1" is produced at both output terminals of the AND gate circuit 38 and the OR gate circuit 48 so that voltages being fed to the terminal $S_0$ produce at the terminal $e_1$. Furthermore the switching circuits 54 to 56, 58 to 60, and 62 are turned ON to produce voltages being fed to the terminal $S_1$ at the terminals $e_2$ to $e_{10}$. In addition the decoder 28 produces a logic "1" at the terminal $y_0$ to produce voltages being fed to terminal $C_0$ at the terminal $k_1$ of FIG. 6. Meanwhile the AND gate circuits 77 to 82 are opened in consequence of that a logic "1" is produced at the terminal $\overline{P_3}$. The above logic level of the terminal $\overline{P_3}$ is for the reason that while a pulse is being produced at the terminal $P_1$ there is no pulse produced at the terminal $P_3$, as a result, a logic at the terminal $P_3$ being "0", therefore a logic "1" is resulted from the terminal $\overline{P_3}$ which an inverted output from the terminal $P_1$ is produced.

Now since the gate circuits 77 to 82 are opened, the switching circuit 83 is turned ON to produce voltages fed to the terminal $C_0$ at the terminal $g_1$. Meanwhile voltages fed to the terminal $C_1$ produce at the terminals $k_2$ to $k_6$ and $g_2$ to $g_6$. Since the voltages described hereinbefore are fed to the terminals, as will be seen from the Table of FIG. 7, the display element denoting a time unit of a second corresponding to the segment electrode S of FIG. 2 is displayed.

In case the periodical pulses are produced at the terminal $P_2$ of the timing pulse generator 10 in FIG. 1A, the AND gate circuits 20 and 23 are opened to permit the counted time data "5" and "0" of the counters 5 and 6, respectively to pass therethrough. Therefore a logic "1" produces at the terminal $x_5$ of the decoder 26, at the terminal $y_0$ of the decoder 28 and at the terminal $\overline{h}$, and further a logic "0" produces at the terminal h. Consequently a logic "1" produces at the output terminal of the gate circuit 50 of FIG. 4 and the switching circuit 57 is turned ON, so that voltages fed to the terminal $S_0$ produce at the terminal $e_6$. Voltages fed to the terminal $S_1$ produce at the terminals $e_1$ to $e_5$ and $e_7$ to $e_{10}$. In FIG. 6 voltages fed to the terminal $C_0$ produce at the terminals $g_1$, $k_1$ and voltages fed the terminal $C_1$ produce at the terminal $g_2$ to $g_6$ and $k_2$ to $k_6$. As will be seen from the Table of FIG. 7, there is displayed a display element of minute which is constructed of the segment electrode M(see for FIG. 2) connected to the terminal $e_6$ and the common electrodes connected to the terminals $g_1$, $k_1$.

In case periodical pulses are produced at the terminal $P_3$ of the timing pulse generator 10, the AND gate circuits 21 and 24 are opened to permit the counted time data "0" and "5" from the counters 7 and 8 to pass therethrough. Consequently voltages being fed to the terminal $S_0$ produce at the terminal $e_{10}$ of the segment voltage supply circuit 31, voltages being fed to the terminal $C_0$ produce at the terminal $k_6$ and voltages being fed to the terminal $C_1$ produce at the terminals $k_1$ to $k_5$. While one pulse produces at the terminal $P_3$ a logic level of which comes to "1" and thus that on the terminal $\overline{P_3}$ is kept at "0", the outputs of the AND gate circuits 77 to 82 comes to a logic "0". Consequently voltages being fed to the terminal $C_1$ produce at the terminals $g_1$ to $g_6$. Therefore a display element, which comprises a segment electrode H of FIG. 2 electrically connected with the terminal $e_{10}$ and a common electrode connected to the terminal $k_6$, is displayed.

The voltages periodically applied by the segment voltage supply circuit 31 and the common voltage supply circuit 32 to the terminals $e_1$ to $e_{10}$, $g_1$ to $g_6$ and $k_1$ to $k_6$ comprise pulse signals which, in a manner known in the art, energize the segment and common electrodes of the display device.

As will be apparent hereinbefore, the display elements corresponding to the segment electrodes H, M and S display 10 hours 5 minutes 0 seconds.

Below is explained the time adjusting operation. When the manual switch 17 of FIG. 1C is closed, the frequency divider 2 and the contents of time units of seconds are reset, so that the contents in the counters 3 and 4 become "0". Furthermore the AND gate circuit 34 is opened to enable time adjusting pulses to pass therethrough. A logic "1" produced on the line $L_6$ opens the AND gate circuit 15, so that pulses produced at the terminals $P_1$ and $P_2$ of the timing pulse generator 10 appear at the terminal $M_2$. Consequently the AND gate circuits 19 and 22 of time units of seconds are held in a closed condition, the AND gate circuits 20 and 23 of time units of minutes are opened during selection of the time units of seconds and minutes, and the AND gate circuits 21 and 24 of time units of hours are opened responsive to pulses produced at the terminal $P_3$. In this state, as pulses are generated from the time adjusting pulse generator 33 by manual operation, the contents in the counters 5 to 8 are changed every time the respective pulses are inputed, by which speed shifting a display portion from one to the next display element is altered depending upon a period when the contents in the counters 5 and 6 are successively changed.

Here, in the case of adjusting the time, the AND gate circuits 20 and 23 are opened twice during the time of a period when they are opened when the usual time display (in no time adjustment is being carried out), so that in the time adjusting state the effective value of voltage to be applied to the liquid crystal comes to be larger by $\sqrt{2}$ multiple to accordingly increase the response speed of the liquid crystal and enhance the display contrast. Therefore even if the frequency of pulses for adjusting the time becomes relatively higher, the display elements for minute will be turned on.

It is understood that the control time of the AND gate circuit 20 and 23 is not limited to that of the embodiment described hereinbefore. For example, in case of adjusting the time, it may be also possible to make the effective value of the voltages larger than in the case of the usual time display by time-divisionally controlling the gate circuits for minutes and hours under keeping the gate circuits 19, 22 for seconds at a closed state. As mentioned above in detail, according to this invention since the effective value of voltages to be applied to the display elements for adjusting the time is a larger value than that of the usual time display, even if the frequency of pulses for adjusting the time comes to be relatively higher, a display element to be adjusted will be turned on. In this manner, when the time is being adjusted, the contrast between the display and non-display portions is enhanced, and as a result it is easy to recognize the shifting of the adjusting display portion.

What is claimed is:

1. An electronic timepiece, comprising:

an optical display device having a number of separate display elements in the shape of time-indicating hands and including electrodes comprised of a number of segment electrodes in the shape of time-indicating hands arranged so as to extend radially from a point, and common electrodes formed in at least two concentric rings and divided into sector-like electrodes each of which opposes a group of an equal number of the segment electrodes, means defining circuit paths connecting a corresponding segment electrode in each of the groups without crossing one another, and optical display material between the segment electrodes and the common electrodes;

a clock pulse generator for generating clock pulses;

time counting means receptive of the clock pulses for counting time and generating time data;

selection means connected to receive the time data for time-divisionally selecting therefrom time units representative of time and for providing selected outputs of time units representative of time;

first means including a first voltage supply circuit for developing and applying pulse signals to the segment electrodes of the display elements for turning ON selected ones of the segment electrodes in response to one output of time units selected at the same time by the selection means and for developing and applying pulse signals to the remaining non-selected ones of the segment electrodes for turning OFF the remaining segment electrodes;

second means including a second voltage supply circuit for developing and applying pulse signals to the common electrodes of the display elements for turning ON selected ones of the common electrodes in response to another output of time units selected at the same time by the selection means and for applying pulse signals to the remaining non-selected ones of the common electrodes for turning OFF the remaining common electrodes; and time adjusting means for setting the time counting means in a time-adjustment mode and for applying time adjusting pulse signals to the time counting means when the same is in the time-adjustment mode for adjusting the contents of the time counting means, the time adjusting pulse signals being applied for a longer effective period during time adjustment than the period of the pulse signals applied to the electrodes when no time adjustment is being made.

2. An electronic timepiece comprising: a display device for displaying time information including at least hours and minutes, said display device comprising a plurality of segment electrodes having elongate sections which are arranged in side-by-side relationship in a generally circular array, a plurality of common electrodes of sector-like shape arranged in at least two concentric rings with each sector-like electrode being spaced from and opposing a group of an equal number of the segment electrodes, means defining circuit paths connecting corresponding ones of the segment electrodes in each of the groups of segment electrodes, and electro-optical material disposed between the segment electrodes and the common electrodes; a crystal oscillator for generating a high frequency oscillatory signal suitable for use as a time standard; a frequency divider connected to receive the high frequency oscillatory signal for dividing the same into a succession of lower frequency signals; time counting means receptive of the lower frequency signals for counting the same and producing timing signals representative of different units of time including at least hours and minutes; circuit means receptive of the timing signals for developing therefrom a first set of pulse signals corresponding in number to the number of segment electrodes in each group and for applying the first set of pulse signals to the segment electrodes and for developing therefrom a second set of pulse signals corresponding in number to the number of common electrodes and for applying the second set of pulse signals to the common electrodes to thereby energize the segment and common electrodes in such manner to cause the display device to display time information corresponding to at least hours and minutes, the circuit means comprising means defining a plurality of terminals each maintained at a different voltage level during use of the timepiece, selecting means connected to the terminals for periodically selecting different voltages and applying the selected voltages to a plurality of output terminals in a predetermined sequence, first voltage supply means connected to one group of the output terminals and responsive to the timing signals for developing the first set of pulse signals having voltage levels corresponding to the voltage levels at said one group of output terminals, and second voltage supply means connected to another group of the output terminals and responsive to the timing signals for developing the second set of pulse signals having voltage levels corresponding to the voltage levels at said another group of output terminals; and manually-actuated time adjusting means connected to the time counting means for adjusting the contents thereof such that the pulse signals corresponding to the time units being adjusted are applied to the display device electrodes for a longer effective period of time as compared to when no time adjustment is being made to thereby adjust the time information display by the displayed device.

3. An electronic timepiece according to claim 1; wherein said one and another groups of output terminals are each comprised of output terminals different from those in the other group.

4. An electronic timepiece according to claim 2; wherein the time adjusting means includes means coacting with the circuit means for enhancing the contrast of the displayed time information during periods of time adjustment as compared to other periods when no time adjustment is being made.

* * * * *